US006870530B2

(12) United States Patent
Bu et al.

(10) Patent No.: US 6,870,530 B2
(45) Date of Patent: Mar. 22, 2005

(54) METHOD OF DISPLAY IN WHICH FRAMES ARE DIVIDED INTO SUBFRAMES AND ASSIGNED DRIVING SHIFT VOLTAGES

(75) Inventors: Lin-Kai Bu, Tainan (TW); Li-Yi Chen, Nantou (TW)

(73) Assignee: Chi Mei Optoelectronics Corp. (TW)

( * ) Notice: Subject to any disclaimer, the term of this patent is extended or adjusted under 35 U.S.C. 154(b) by 255 days.

(21) Appl. No.: 10/124,487

(22) Filed: Apr. 18, 2002

(65) Prior Publication Data

US 2002/0171640 A1 Nov. 21, 2002

(30) Foreign Application Priority Data

May 21, 2001 (TW) ..... 90112165 A

(51) Int. Cl.[7] ..... G09G 5/00; G09G 3/36
(52) U.S. Cl. ..... 345/208; 345/94; 345/95
(58) Field of Search ..... 345/87–100, 204–213, 345/60, 82

(56) References Cited

U.S. PATENT DOCUMENTS 6,011,606 A * 1/2000 Ohe et al. ..... 349/141
6,046,716 A * 4/2000 McKnight ..... 345/95
6,215,466 B1 * 4/2001 Yamazaki et al. ..... 345/89
6,423,385 B1 * 7/2002 Kagawa et al. ..... 428/1.1

* cited by examiner

*Primary Examiner*—Amr A. Awad
(74) *Attorney, Agent, or Firm*—Finnegan, Henderson, Farabow, Garrett & Dunner, LLP

(57) ABSTRACT

A method of display by sub-frame driving on a monitor. The monitor has pixels arranged in an m*n array, where m and n are integers. The monitor receives a frame signal for displaying a frame for a frame periods. The frame signal includes pixel data for each of the pixels of the monitor. The frame period is divided into k sub-frame periods, a sub-frame being displayed during each of the sub-frame period. Each of the sub-frames corresponds to a driving shift voltage, and the method displays the sub-frames sequentially, wherein the method of displaying the pixel (i,j) of the p-th sub frame includes applying a driving voltage (i,j) to the pixel (i,j). The driving voltage (i,j) is a target driving voltage corresponding to the pixel (i,j) plus the corresponding driving shift voltage.

18 Claims, 5 Drawing Sheets

METHOD OF DISPLAY IN WHICH FRAMES ARE DIVIDED INTO SUBFRAMES AND ASSIGNED DRIVING SHIFT VOLTAGES

This application incorporates by reference of Taiwan application Serial No. 90112165, filed May 21, 2001.

BACKGROUND OF THE INVENTION

1. Field of the Invention

The invention relates in general to the method of display by sub-frame driving, and more particularly to the method of display on a monitor by sub-frame driving.

2. Description of the Related Art

With the improvement and innovation of science and technology, the development of display technology has advanced rapidly and has made progress at a tremendous pace. The traditional CRT (Cathode Ray Tube) display has gradually dropped out the display market due to its large volume and serious radiation and is gradually being replaced by LCD (Liquid Crystal Display), OLED (Organic Light Emitter Diode), or PDP (Plasma Display Panel), which are thin and have low radiation, and low power consumption.

The frame data input to the display has two parts—pixel data and display timings. A driving voltage is determined according to the pixel data, and then the brightness of a pixel is determined according to the driving voltage. In addition to the pixel data, the frame data include a set of display timings, which have three parameters. The three parameters are Hs (Horizontal Synchronous signal), Vs (Vertical Synchronous signal), and CK (pixel clock). CK (pixel clock) represents the number of the pixels per second, which determines the interval between the action of displaying colors of some pixel and that of the next pixel. When the pixel corresponding to the input pixel data is the last pixel in a row, Hs (Horizontal Synchronous signal) controls to display the first pixel in the next row. Therefore, Hs (Horizontal Synchronous signal) determines the number of the rows per second. When the pixel corresponding to the input pixel data is the pixel of the last column of the last row in the screen, Vs (Vertical Synchronous signal) controls to display the first pixel of the first row. Therefore, Vs (Vertical Synchronous signal) determines the number of the displayed frames per second.

Take an LCD monitor for example. The transparency of each pixel is changed according to the driving voltage Vd applied, and accordingly the brightness of the pixel is determined. According to the pixel data, a target driving voltage $V_D$ is determined to let the pixel achieve a target transparency $T_D$. When the driving voltage Vd rises to the target driving voltage $V_D$, the transparency of the pixel cannot achieve the target transparency $T_D$ in real time due to the slow response of the liquid crystal in the pixel of the LCD monitor. FIG. 1A is a diagram of the driving voltage Vd of the pixel (i,j) vs. time. Pixel (i,j) is one of the pixels in the LCD monitor. The driving voltage Vd reaches the target driving voltage $V_D$ in a short time. FIG. 1B is a diagram of the transparency of the pixel (i,j) vs. time. When the driving voltage Vd is applied to the pixel (i,j), the transparency of the pixel (i,j) rises accordingly. But the transparency of the pixel (i,j) takes a longer period t1 to reach the target transparency $T_D$.

A well-known method to speed up the response of the liquid crystal is to apply an over-drive voltage Vo, which is higher in magnitude than the desired target driving voltage $V_D$. FIG. 2A is a diagram of the driving voltage Vd vs. time using the over-drive method. First, the driving voltage Vd rises to the over-drive voltage Vo for speeding up the response of the liquid crystal in pixel (i,j). FIG. 2B is a diagram of the transparency of the pixel (i,j) vs. time according to the driving voltage Vd shown in FIG. 2A. The transparency of the pixel (i,j) reaches the target transparency $T_D$ faster than that shown in FIG. 1B.

However, it is not easy to control the magnitude of the over-drive voltage Vo. If the over-drive voltage Vo is too high, the transparency may exceed the target transparency $T_D$; if the over-drive voltage Vo is too low, the response of the liquid crystal may not be fast enough.

SUMMARY OF THE INVENTION

It is therefore an object of the invention to provide a method of driving pixels to shorten the response time thereof.

The invention achieves the above-identified objects by providing a method of display by sub-frame driving on a monitor. The monitor has pixels arranged in an m*n array, where m and n are integers. The monitor receives a frame signal for displaying a frame for a frame period. The frame signal includes the pixel data for each of the pixels of the monitor. The frame period is divided into a first sub-frame period and a second sub-frame period. A first sub frame is displayed during the first sub-frame period, and a second sub frame is displayed during the second sub-frame period. The first sub frame corresponds to a first driving voltage, and the second sub frame corresponds to a second driving voltage. The first driving voltage and the second driving voltage for the pixel (i,j) are unequal, wherein $0<i\leqq m$, $0<j\leqq n$, i, and j are integers. The method comprises the steps of displaying the first sub-frame according to the first driving voltage and displaying the second sub-frame according to the second driving voltage.

Other objects, features, and advantages of the invention will become apparent from the following detailed description of the preferred but non-limiting embodiments. The following description is made with reference to the accompanying drawings.

DETAILED DESCRIPTION OF THE INVENTION

The method of display by sub-frame driving according to this invention is used for displaying frames on a monitor.

The monitor has pixels arranged in an m*n array, where m and n are integers. The monitor receives a frame signal for displaying a frame for a frame period. For example, if the refresh rate of the monitor is 60 Hz, the frame period is 1/60 second. The frame signal includes the pixel data for each of the pixels of the monitor. In this invention, the frame period is divided into k sub-frame periods, and a sub frame is displayed during each of the sub-frame periods. In other words, a frame is displayed during k steps, and at each step a sub-frame is displayed for the corresponding sub-frame period. Each of the sub frames corresponds to a driving shift. Note that the sub-frame periods are not necessarily equal and k is an integer.

The preferred embodiment according to this invention takes an LCD monitor for example. Each pixel of the LCD monitor includes liquid crystal, and the transparency of the liquid crystal is determined by a driving voltage. A frame period is divided into a first sub-frame period and a second sub-frame period. A frame is displayed in two steps: a first sub-frame is displayed during the first sub-frame period, and then a second sub-frame is displayed during the second sub-frame period. The first sub-frame corresponds to a first driving shift, and the second sub-frame corresponds to a second driving shift.

The method of displaying a frame by sub-frame driving includes the following steps. First, display the first sub frame for the first sub-frame period at time ts0. Then display the second sub frame for the second sub-frame period at time ts1.

While the first sub frame is displayed, the driving voltage is the over-drive voltage Vo generated from the target driving voltage $V_D$, derived from the pixel data, plus the first driving shift. The first driving shift is larger than zero, and thus speeds up the response of the liquid crystal. While the second sub frame is displayed, the driving voltage is the target driving voltage $V_D$, derived from the pixel data, plus the second driving shift. The second driving shift is zero in this embodiment for maintaining the transparency of the liquid crystal at the target transparency $T_D$.

Figure 1A:
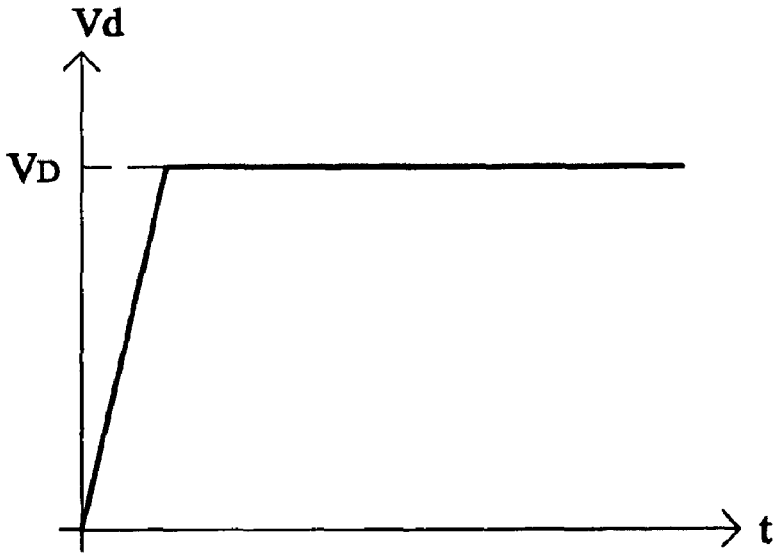
FIG. 1A (PRIOR ART)
FIG. 1A is a diagram of the driving voltage Vd of the pixel (i,j) vs. time.
Figure 1B:
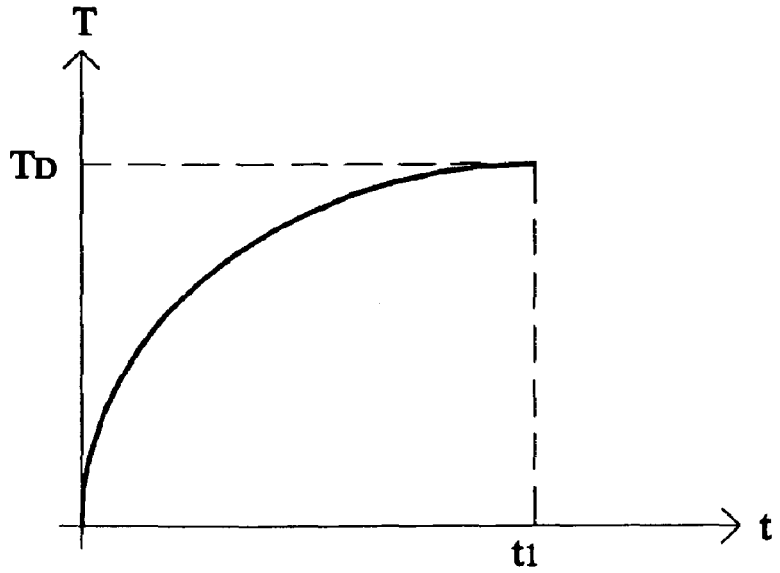
FIG. 1B (PRIOR ART)
FIG. 1B is a diagram of the transparency of the pixel vs. time.
Figure 2A:
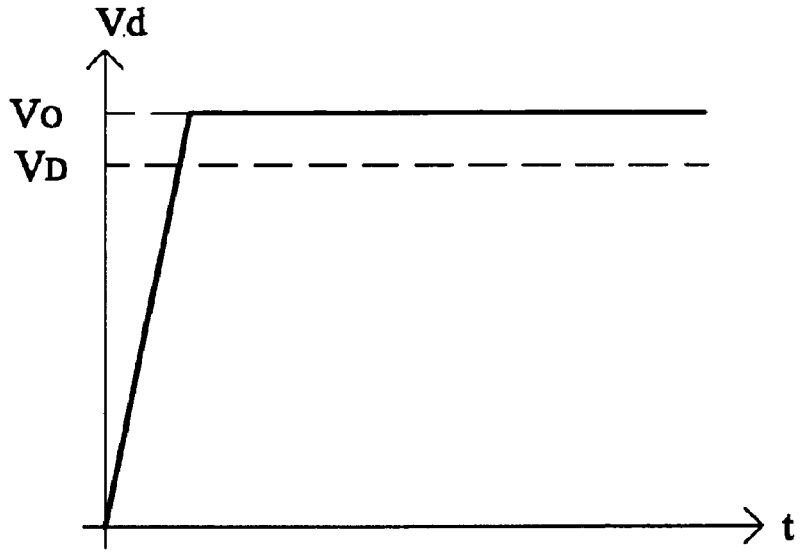
FIG. 2A (PRIOR ART)
FIG. 2A is a diagram of the driving voltage vs. time using the over-drive method.
Figure 2B:
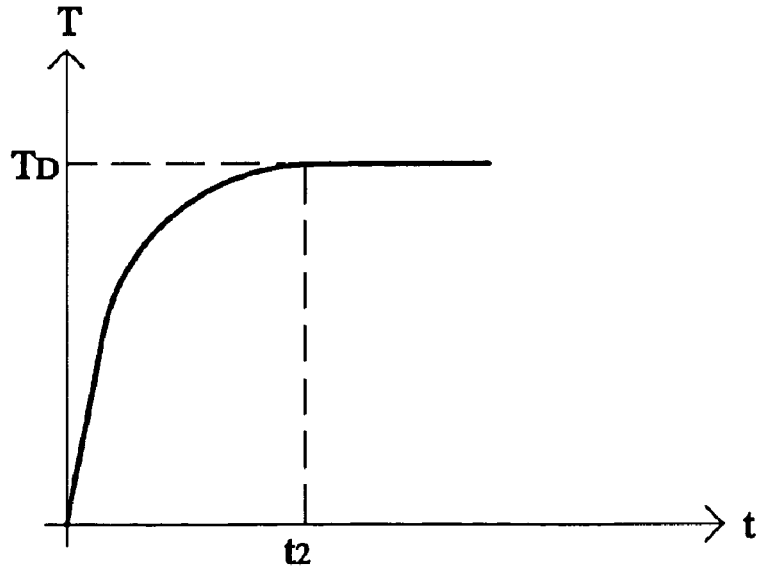
FIG. 2B (PRIOR ART)
FIG. 2B is a diagram of the transparency of the pixel vs. time according to the driving voltage shown in FIG. 2A.
Figure 3A:
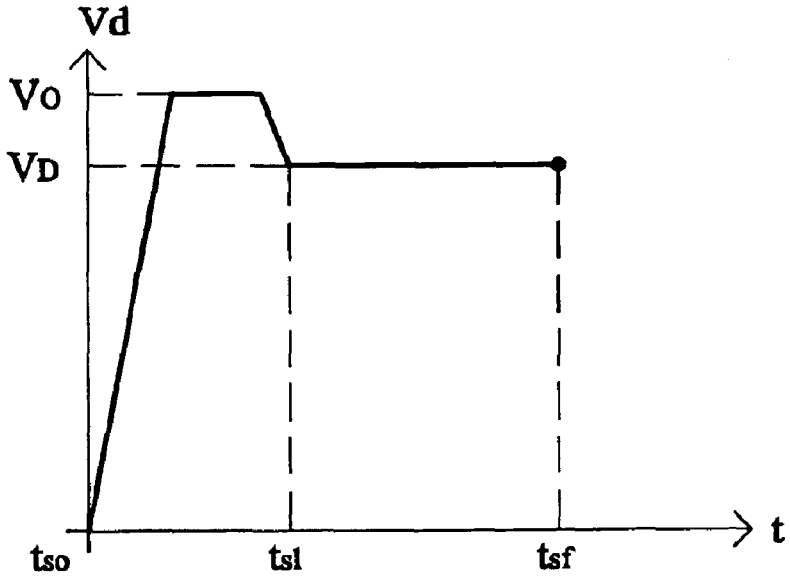
FIG. 3A is a diagram of the driving voltage for the pixel according to this embodiment.
Figure 3B:
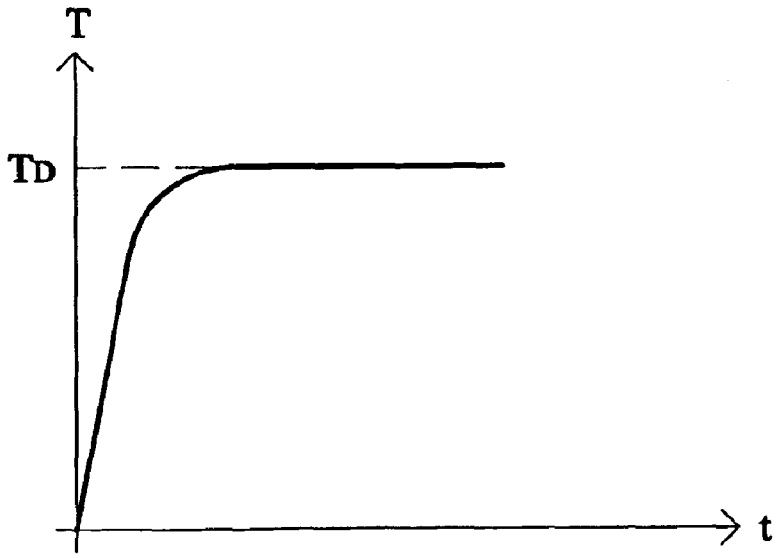
FIG. 3B is a diagram of the transparency for the pixel.

FIG. 3A is a diagram of the driving voltage Vd(i,j) for the pixel (i,j) according to this embodiment. FIG. 3B is a diagram of the transparency for pixel (i,j). At time ts0, display the first sub frame by inputting the over-drive voltage Vo to the pixel (i,j) to speed up the response of the liquid crystal. Then, at time ts1, display the second sub frame by inputting the driving voltage Vd to pixel (i,j). Because the second driving shift is zero, the driving voltage Vd is equal to the target driving voltage $V_D$ for maintaining the transparency of the pixel (i,j) at the target transparency $T_D$.

Figure 4A:
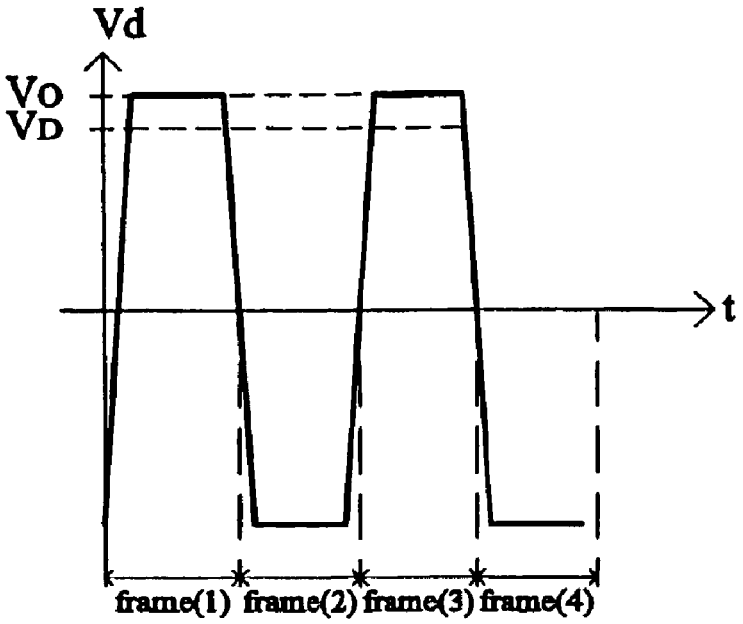
FIG. 4A (PRIOR ART)
FIG. 4A is a diagram of the driving voltage for the pixel according to the traditional method of over driving.
Figure 4B:
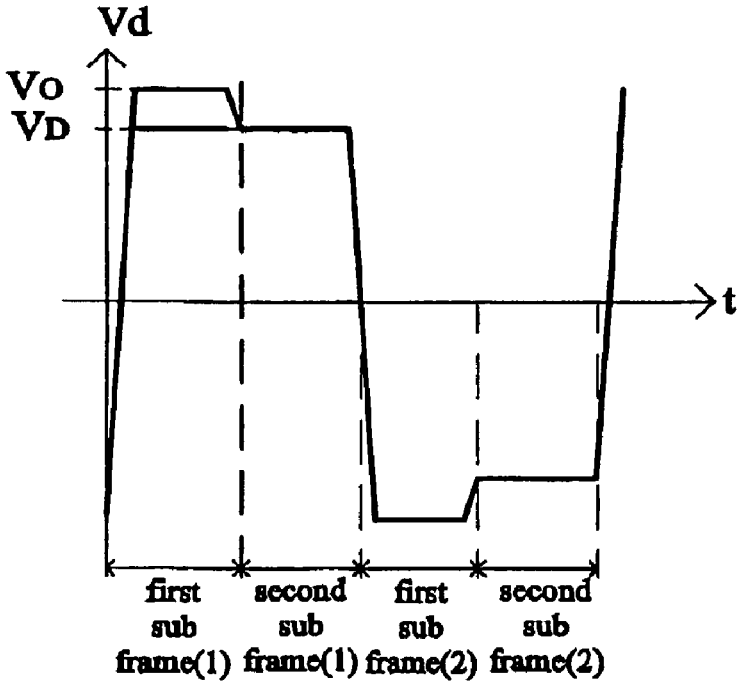
FIG. 4B is a diagram of the driving voltage for the pixel according to the first embodiment.

FIG. 4A is a diagram of the driving voltage for pixel (i,j) according to the traditional method of over driving. Polarization switch is needed when a frame is switched to another, which is well known. The refresh rate should be doubled if the traditional over driving method is adopted for better performance. FIG. 4B is a diagram of the driving voltage Vd for pixel (i,j) according to the first embodiment. The driving voltages for sub frames of the same frame are of the same polarity. The refresh rate of the embodiment is the same as that of the traditional over driving method. However, the number of polarity switching is less than that of the traditional over driving method. Accordingly, the power consumption is reduced.

The above-mentioned embodiment controls the magnitude of the first sub-frame period and the first driving shift to speed up the response time, and then maintain the target transparency during the second sub-frame period. Accordingly, the control is simpler.

Figure 5A:
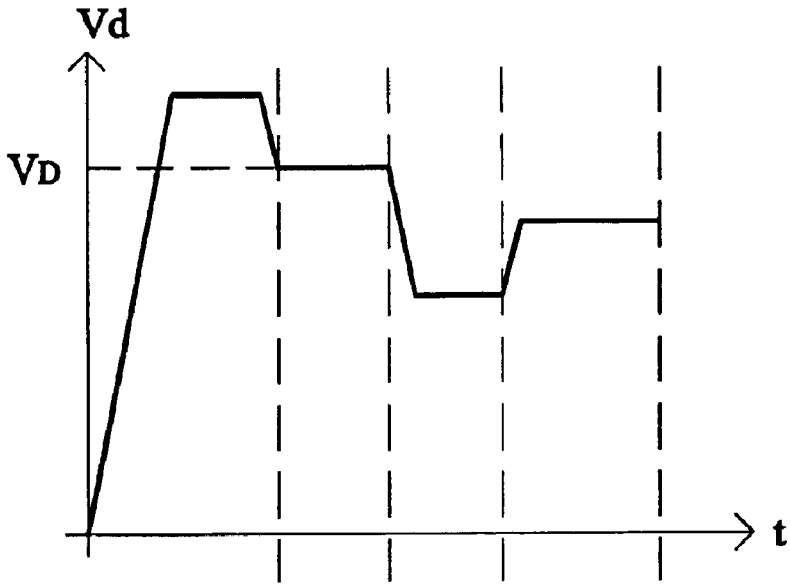
FIG. 5A is a diagram of the driving voltages for four sub frames per frame according to another embodiment of this invention.
Figure 5B:
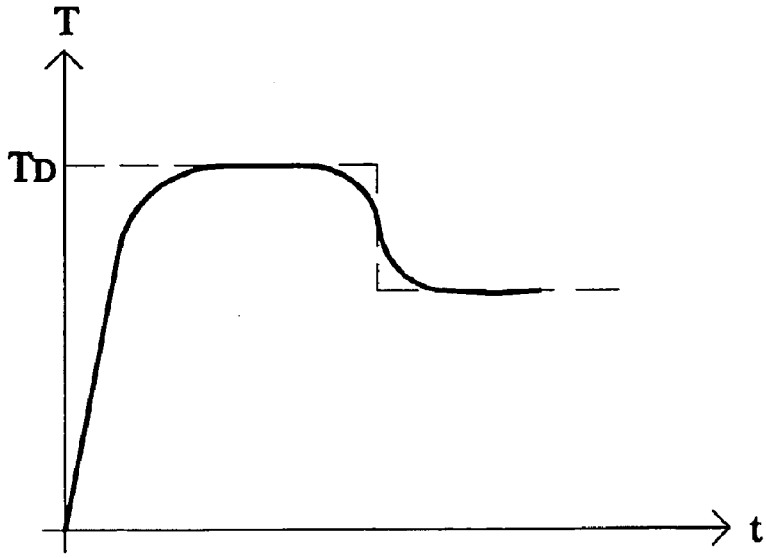
FIG. 5B is a diagram of the transparency by the driving voltages shown in FIG. 5A.

The invention is not limited to the two sub frames for a frame. More sub frames for a frame can be used. FIG. 5A is a diagram of the driving voltage for four sub frames per frame according to another embodiment of this invention. Refer to FIG. 5B at the same time. FIG. 5B is a diagram of the transparency by the driving voltages shown in FIG. 5A. This embodiment has the ability to process light signals. The monitors have two categories: impulse type and hold type. The CRT monitor is an example of the impulse type monitor. The LCD, OLED, and PDP are examples of the hold type monitor. The impulse type monitor utilizes an electron beam to hit on the screen. The hitted pixel is bright, while the un-hitted pixels are dark. The pixels of the hold type monitor remain the brightness according to the inputted pixel data. The image quality of the hold type monitor is not as good as that of the impulse type monitor, because the high-frequency part of the image on the hold type monitor is less. The driving voltages shown in FIG. 5A can compensate the high-frequency part to enhance the image quality.

The invention displays one frame at several steps. A sub frame is displayed during each step. Although the refresh rate increases if the number of the sub frames per frame increases, the polarity of the driving voltage for the sub frames of a frame remain the same. Accordingly, the power is saved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for driving a display having including pixels (i,j) arranged in an m*n array, i, j, m and n being integers, the display receiving a frame signal for displaying a frame for a frame period, the frame signal including pixel data for each of the pixels of the display, the method comprising the steps of:

(a) dividing the frame into a sequence of k sub-frames and the frame period into a sequence of k sub-frame periods;

(b) displaying the pixel data continuously during the sequence of sub-frames, step (b) comprising displaying each pixel (i,j) of a p-th sub-frame by applying a driving voltage (i,j) to the pixel (i,j), the driving voltage (i,j) being a target driving voltage corresponding to the pixel data for the pixel (i,j) plus a driving shift voltage corresponding to the p-th sub-frame, wherein $1 \leqq p \leqq k$, $0 < i \leqq m$, $0 < j \leqq n$, p, and k are integers.

2. The method according to claim 1, wherein the driving voltages for the pixel (i,j) at each of the k sub-frames are of the same polarity.

3. The method according to claim 1, wherein k is set to 2.

4. The method according to claim 1, wherein the sub-frame periods are unequal.

5. The method according to claim 1, wherein the display is an LCD (Liquid Crystal Display).

6. The method according to claim 1, wherein the display is an OLED (Organic Light Emitter Diode) display.

7. The method according to claim 1, wherein the display is a PDP (Plasma Display Panel).

8. A method for driving a display having pixels (i,j) arranged in an m*n array, i,j, m and n being integers, the display receiving a frame signal for displaying a frame for a frame period, the frame signal including pixel data for each of the pixels of the display, comprising the steps of:

(a) dividing the frame period into a first sub-frame period and a second sub-frame period, a first sub-frame being displayed during the first sub-frame period, and a second sub-frame being displayed during the second sub-frame period;

(b) displaying the first sub-frame, the first sub-frame corresponding to a first driving shift voltage, step (b) comprising displaying each pixel (i,j) of the first sub-frame by applying a first driving voltage (i,j) to each pixel (i,j), the first driving voltage (i,j) being a target driving voltage corresponding to the pixel data for the pixel (i,j) plus a first driving shift voltage assigned to the first sub-frame, wherein $0<i\leqq m$, $0<j\leqq n$, and p is an integer; and (c) displaying the second sub-frame, the second sub-frame corresponding to a second driving shift voltage, step (c) comprising displaying each pixel (i,j) of the second sub-frame by applying a second driving voltage (i,j) to each pixel (i,j), the second driving voltage (i,j) being a target driving voltage corresponding to the pixel data for the pixel (i,j) plus a second driving shift voltage assigned to the second sub-frame;

wherein the pixel data is displayed continuously during the first and second sub-frames.

9. The method according to claim 8, wherein the driving voltages for the pixel (i,j) at the first and second sub-frames are of the same polarity.

10. The method according to claim 8, wherein the sub-frame periods are unequal.

11. The method according to claim 8, wherein the display is an LCD (Liquid Crystal Display).

12. The method according to claim 8, wherein the display is an OLED (Organic Light Emitter Diode) display.

13. The method according to claim 8, wherein the display is a PDP (Plasma Display Panel).

14. A method for driving a display having pixels arranged in an m*n array, m and n being integers, the display receiving a frame signal for displaying a frame for a frame period, the frame signal including pixel data for each of the pixels of the display, comprising the steps of:

(a) dividing the frame period into a first sub-frame period and a second sub-frame period;

(b) displaying a first sub-frame during the first sub-frame period and a second sub-frame during the second sub-frame period, the first sub-frame being assigned a first driving shift voltage, and the second sub-frame being assigned a second driving shift voltage, the first driving shift voltage and the second driving shift voltage for the pixel (i,j) being unequal;

wherein step (b) comprises displaying the pixel data during the first sub-frame according to the first driving shift voltage, and displaying the pixel data during the second sub-frame according to the second driving shift voltage, and wherein the pixel data is displayed continuously during the first and second sub-frames.

15. The method according to claim 14, wherein the first sub-frame period and the second sub-frame period are unequal.

16. The method according to claim 14, wherein the display is an LCD (Liquid Crystal Display).

17. The method according to claim 14, wherein the display is an OLED (Organic Light Emitter Diode) display.

18. The method according to claim 14, wherein the display is a PDP (Plasma Display Panel).

* * * * *

UNITED STATES PATENT AND TRADEMARK OFFICE

CERTIFICATE OF CORRECTION

PATENT NO. : 6,870,530 B2
DATED : March 22, 2005
INVENTOR(S) : Lin-Kai Bu et al.

It is certified that error appears in the above-identified patent and that said Letters Patent is hereby corrected as shown below:

Column 4,
Line 37, delete "including".

Signed and Sealed this

Twenty-third Day of August, 2005

JON W. DUDAS
*Director of the United States Patent and Trademark Office*